US006899922B2

(12) United States Patent
Leonard et al.

(10) Patent No.: US 6,899,922 B2
(45) Date of Patent: May 31, 2005

(54) METHOD FOR COATING A LIMITED LENGTH SUBSTRATE USING ROTATING SUPPORT AND AT LEAST ONE PICK-AND-PLACE ROLL

(75) Inventors: William K. Leonard, River Falls, WI (US); David W. Leonard, River Falls, WI (US); Bruce D. Shalles, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 304 days.

(21) Appl. No.: 10/044,276

(22) Filed: Jan. 10, 2002

(65) Prior Publication Data

US 2003/0003238 A1 Jan. 2, 2003

Related U.S. Application Data

(63) Continuation-in-part of application No. 09/757,955, filed on Jan. 10, 2001, now Pat. No. 6,737,113, and a continuation-in-part of application No. 09/841,380, filed on Apr. 24, 2001.

(51) Int. Cl.[7] ..... B05D 1/28
(52) U.S. Cl. ..... 427/359
(58) Field of Search ..... 427/359

(56) References Cited

U.S. PATENT DOCUMENTS 1,043,021 A 10/1912 Mayer
2,105,488 A 1/1938 Massey et al.

(Continued)

FOREIGN PATENT DOCUMENTS

DE 2304987 8/1974
EP 1 088 595 A 4/2001
GB 1 293 045 * 4/1971 ..... B05C/1/08
GB 1 278 099 6/1972
WO WO 01/96661 A1 12/2001

OTHER PUBLICATIONS

Booth, G.L., "The Coating Machine", *Pulp and Paper Manufacture*, vol. 8, pp. 76–87, Third Edition, 1990.

Booth, G.L., *Evolution of Coating*, vol. 1, Gorham International Incorporated.

Gutoff, Edgar R. and Cohen, Edward D., "Problems Associated with Roll Coating an Related Processes", *Coating and Drying Defects*, pp. 74–95, 1995.

Benjamin, Dean F., Anderson, Todd J., and Scriven, L.E., "Multiple Roll Systems: Steady–State Operation", AlChE Journal, V41, pp. 1045–1060, 1995.

(Continued)

*Primary Examiner*—Bret Chen
*Assistant Examiner*—William Phillip Fletcher, III
(74) *Attorney, Agent, or Firm*—Brian E. Szymanski

(57) ABSTRACT

Continuous void-free uniform coatings are formed on substrates of limited length. The substrate is wrapped around a mounting roll and nipped between the mounting roll and one or more pick-and-place contacting rolls. Coating liquid is applied to the substrate or to a pick-and-place roll, preferably as a pattern of stripes. The mounting roll, substrate and pick-and-place rolls are caused to rotate for a plurality of revolutions. Wetted surface portions of the pick-and-place roll repeatedly contact the substrate, the coating is repeatedly picked up from and placed onto the substrate, and the coating becomes more uniform. Extremely uniform and extremely thin coatings can be quickly and easily obtained, with easy adjustment of the final coating thickness.

25 Claims, 13 Drawing Sheets

U.S. PATENT DOCUMENTS

| | | | | |
|---|---|---|---|---|
| 2,105,981 | A | | 1/1938 | Massey et al. |
| 2,229,620 | A | | 1/1941 | Bradner |
| 2,229,621 | A | | 1/1941 | Bradner |
| 2,237,045 | A | | 4/1941 | Bradner |
| 2,245,045 | A | | 6/1941 | Bradner |
| 2,388,339 | A | | 11/1945 | Paxton et al. |
| 2,977,243 | A | | 3/1961 | Meier |
| 3,018,757 | A | | 1/1962 | Loppnow |
| 3,169,081 | A | | 2/1965 | Nelson et al. |
| 3,718,117 | A | | 2/1973 | Lewicki, Jr. |
| 3,920,862 | A | | 11/1975 | Damschroder et al. |
| 4,020,194 | A | | 4/1977 | McIntyre et al. |
| 4,102,301 | A | * | 7/1978 | Reade et al. ..... 118/67 |
| 4,267,215 | A | | 5/1981 | Riggs |
| 4,354,449 | A | | 10/1982 | Zink |
| 4,378,390 | A | | 3/1983 | Yoshida et al. |
| 4,569,864 | A | | 2/1986 | McIntyre |
| 4,748,043 | A | | 5/1988 | Seaver et al. |
| 4,830,873 | A | | 5/1989 | Benz et al. |
| 5,326,598 | A | | 7/1994 | Seaver et al. |
| 5,332,797 | A | | 7/1994 | Kessel et al. |
| 5,409,732 | A | | 4/1995 | Leonard et al. |
| 5,447,474 | A | | 9/1995 | Chang |
| 5,460,120 | A | | 10/1995 | Paul et al. |
| 5,536,314 | A | | 7/1996 | Rannestad |
| 5,585,545 | A | | 12/1996 | Bennett et al. |
| 5,599,602 | A | | 2/1997 | Leonard et al. |
| 5,620,514 | A | | 4/1997 | Munter et al. |
| 5,702,527 | A | | 12/1997 | Seaver et al. |
| 5,733,608 | A | | 3/1998 | Kessel et al. |
| 5,871,585 | A | | 2/1999 | Most et al. |
| 5,954,907 | A | | 9/1999 | LaRose et al. |
| 6,117,237 | A | | 9/2000 | Yapel et al. |

OTHER PUBLICATIONS

Benjamin, Dean F., Anderson, Todd J., and Scriven, L.E., "Multiple Roll Systems: Residence Times and Dynamic Response", AlChE Journal, V41, pp. 2198–2211, 1995.

Application Ser. No. 09/757,955, filed January 10, 2001, "Coating Device and Method", pp 1–47 (20 sheets of drawings).

Application Ser. No. 09/841,380, filed Apr. 24, 2001, "Electrostatic Spray Coating Apparatus and Method", pp. 1–46 (17 sheets of drawings).

Application Ser. No. 09/841,381, filed Apr. 24, 2001, "Variable Electrostatic Spray Coating Apparatus and Method", pp. 1–44 (17 sheets of drawings).

Application Ser. No. 10/044,237, filed Jan. 10, 2002, "Coating Device and Method Using Pick–and–Place Deives Having Equal or Substanially Equal Periods", pp. 1–58 (38 sheets of drawings).

Merriam–Webster's Collegiate Dictionary, Tenth Edition, Copyright© 1998, definition of "smooth" and definition of "uniform".

* cited by examiner

METHOD FOR COATING A LIMITED LENGTH SUBSTRATE USING ROTATING SUPPORT AND AT LEAST ONE PICK-AND-PLACE ROLL

CROSS-REFERENCE TO RELATED APPLICATIONS

This application is a continuation-in-part of U.S. patent application Ser. No. 09/757,955 filed Jan. 10, 2001 and entitled COATING DEVICE AND METHOD (now U.S. Pat. No. 6,737,113 B1) and of pending U.S. patent application Ser. No. 09/841,380 filed Apr. 24, 2001 and entitled ELECTROSTATIC SPRAY COATING APPARATUS AND METHOD, the entire disclosures of which are incorporated by reference herein.

FIELD OF THE INVENTION

This invention relates to devices and methods for coating substrates of limited length and for improving the uniformity of non-uniform or defective coatings.

BACKGROUND

There are many known methods and devices for coating a moving web and other fixed or moving endless substrates, and for smoothing the resulting coating. Several are described in Booth, G. L., "The Coating Machine", *Pulp and Paper Manufacture*, Vol. 8, *Coating, Converting and Processes*, pp 76–87 (Third Edition, 1990) and in Booth, G. L., *Evolution of Coating*, Vol. 1 (Gorham International Inc.). For example, multiroll coaters (see, e.g., U.S. Pat. Nos. 2,105,488; 2,105,981; 3,018,757; 4,569,864 and 5,536,314) can be used to provide thin coatings. Multiroll coaters are shown by Booth and are reviewed in Benjamin, D. F., Anderson, T. J. and Scriven, L. E. "Multiple Roll Systems: Steady-State Operation", AIChE J., V41, p. 1045 (1995); and Benjamin, D. F., Anderson, T. J. and Scriven, L. E., "Multiple Roll Systems: Residence Times and Dynamic Response", AIChE J., V41, p. 2198 (1995). Commercially available forward-roll transfer coaters typically use a series of three to seven counter rotating rolls to transfer a coating liquid from a reservoir to a web via the rolls. These coaters can apply silicone release liner coatings at wet coating thickness as thin as about 0.5 to about 2 micrometers. The desired coating caliper and quality are obtained by artfully setting roll gaps, roll speed ratios and nipping pressures. Another type of coating device is shown in U.S. Pat. No. 4,569,864, which describes a coating device in which a thick, continuous premetered coating is applied by an extrusion nozzle to a first rotating roll and then transferred by one or more additional rolls to a faster moving web.

Devices for coating substrates of limited length (e.g., small sheets) are also available, and can be used to prepare experimental or test coatings without requiring set up or operation of a web coating apparatus. These are commonly referred to as hand spread devices, and consist of a knifing apparatus in which a gap is set between a knifing edge and a bed plate, and a sheet is pulled through the gap while it is flooded with coating liquid. Another example is a wire-wound rod coater known as a "Mayer Bar" (see U.S. Pat. No. 1,043,021 to Mayer) which can be used to make manual hand spreads on small test sheets.

SUMMARY OF THE INVENTION

Many current coating applications require extremely thin coatings, e.g., on the order of 10 micrometers or less. For such thin coatings, it can be very difficult to form hand spreads having the desired caliper and coating quality. When it is not practical to prepare a suitable hand spread, then typically a coating run must be set up on a suitable web coating apparatus. This takes time and can generate substantial quantities of costly scrap. Additionally, large quantities of raw materials are required for continuous coating.

For thicker coatings, current hand spread techniques are somewhat more suitable. However, even thick hand spread coatings are often deficient in coating quality, caliper uniformity or precise attainment of a target average caliper.

The present invention provides, in one aspect, coating devices and methods for coating substrates of limited length. In one embodiment, a device of the invention comprises:

a) a rotating support having a surface, the surface at least partially covered with a removable substrate of limited length;

b) at least one pick-and-place roll that is nipped against the substrate on the support and whose period of rotation is not equal to the period of rotation of the support;

c) a coating applicator for applying a quantity of coating liquid to the substrate or to the pick-and-place roll; and d) a motion device that rotates the support and substrate for a plurality of revolutions whereby wetted surface portions of the pick-and-place roll repeatedly contact the substrate.

In another embodiment, a method of the invention comprises:

a) providing a rotating support (e.g., a mounting roll) having a surface, the surface at least partially covered with a removable substrate of limited length and, in either order:

i) nipping the substrate between the support and at least one pick-and-place roll whose period of rotation is not equal to the period of rotation of the support; and ii) applying a quantity of coating liquid to the substrate or to the pick-and-place roll; and b) rotating the support and substrate for a plurality of revolutions whereby wetted surface portions of the pick-and-place roll repeatedly contact the substrate.

In particularly preferred embodiments of the devices and methods of the invention, (a) the coating is applied unevenly (e.g., with repeatedly varying, discontinuous or intermittent caliper variations), (b) two or more pick-and-place rolls are employed, (c) the rotational speed of at least one pick-and-place roll is varied with respect to the rotational speed of the support or other pick-and-place roll, (d) at least one pick-and-place roll period of rotation is not periodically related to the period of rotation of the support or (e) at least one pick-and-place roll period of rotation is not periodically related to the period or rotation of at least one other pick-and-place roll.

The devices and methods of the invention facilitate the formation of continuous void-free, uniform and extremely thin coatings on substrates of limited length using low-cost equipment.

DETAILED DESCRIPTION

Figure 1A:
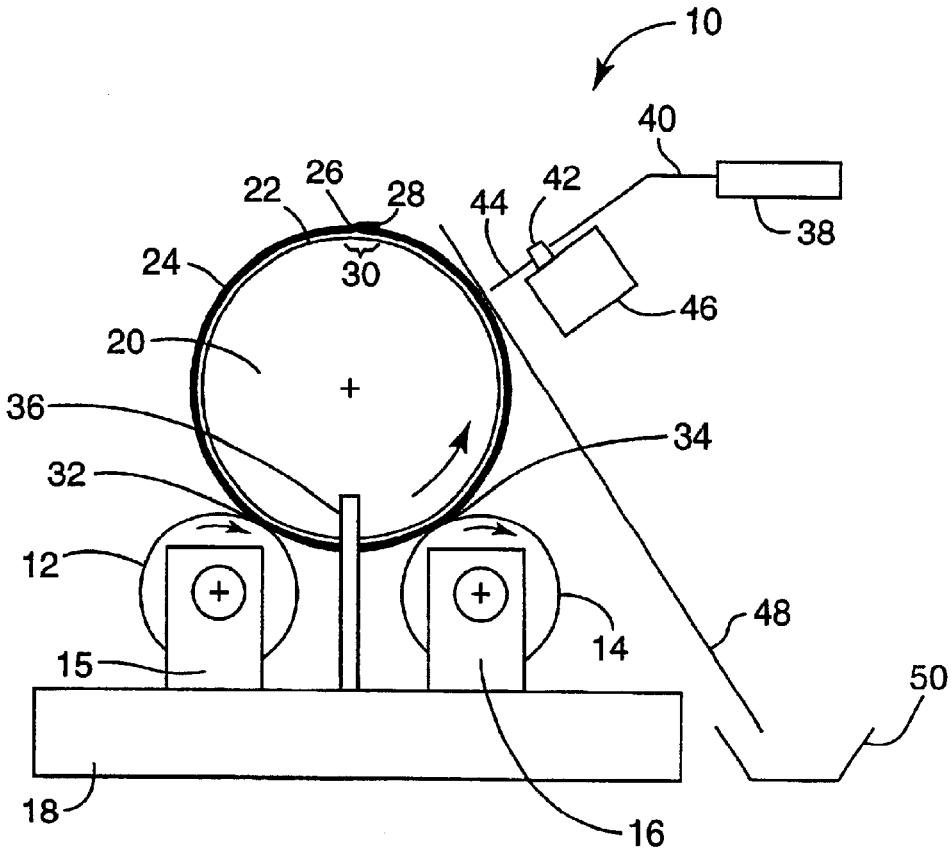
FIG. 1*a* is a schematic side view of a device of the invention.

Referring to FIG. 1*a*, a device 10 of the invention is shown in cross sectional view. Steel "pick-and-place" or contacting rolls 12 and 14 are supported by low friction bearings (not shown in FIG. 1*a*) housed in pedestals 15 and 16 atop base 18. Rolls 12 and 14 are spaced horizontally from one another and in parallel. In the embodiment shown in FIG. 1*a*, contacting rolls 12 and 14 are the same size. If desired, more than two such rolls can be employed. Roll 12 or roll 14 or both can be driven at speeds of, e.g., 1 to 1000 revolutions per minute by a variable drive device not shown in FIG. 1*a*. Rotating support or mounting roll 20 is surrounded by rubber cover 22 and sheet 24. Sheet 24 has a limited length, and ends 26, 28 of sheet 24 overlap slightly at region 30. Roll 20 rests in the gap between and is supported by rolls 12 and 14. The diameters and axes of contacting rolls 12 and 14 and of mounting roll 20 preferably are carefully controlled and aligned, with diameters and surface straightness tolerances of ±10 micrometers being preferred. The weight of roll 20 provides a nipping force that promotes intimate contact between sheet 24 and rolls 12 and 14 in nip points 32 and 34. Retainer stop 36 and an additional retainer stop (not shown in FIG. 1*a*) on the other end of roll 20 prevent sideways axial movement of roll 20. When driven roll 12 rotates, rolls 14 and 20 are driven by surface traction at nearly the same surface speed as roll 12.

Coating liquid from syringe pump 38 is supplied through supply line 40 and feed block 42 to nozzle 44. Oscillating mechanism 46 moves nozzle 44 back and forth across the surface of roll 20. Rest positions are provided at each end of the oscillation stroke. Deflector plate 48 and an additional deflector plate (not shown in FIG. 1*a*) on the other end of roll 20 intercept the flow of coating liquid at each end of the stroke of mechanism 46. The gap between the deflector plates controls the coating width on roll 20, and the plates drain excess coating liquid into a collection trough 50.

Figure 1B:
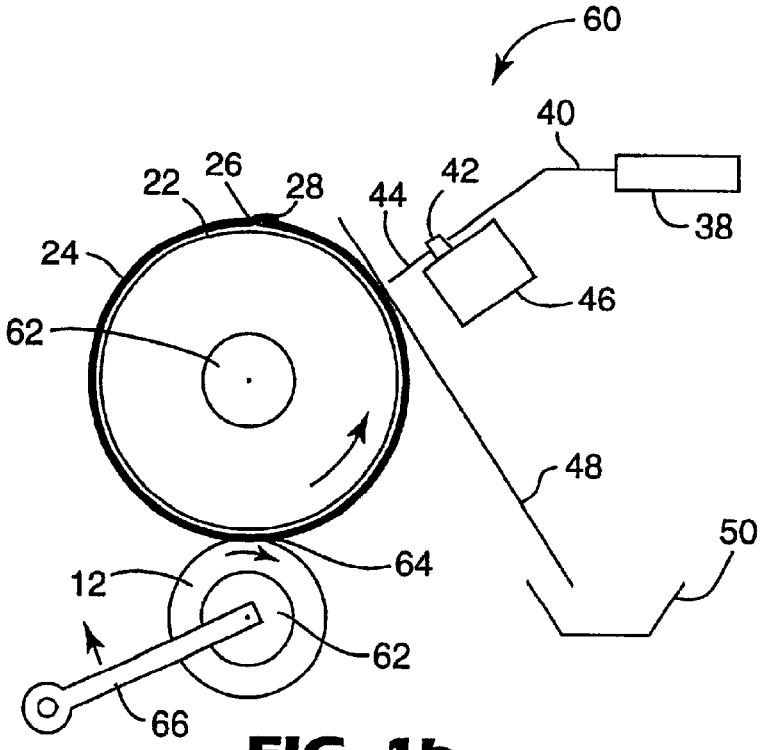
FIG. 1*b* is a schematic side view of another device of the invention.

FIG. 1*b* shows a device of the invention 60 like device 10 in FIG. 1*a*, but in which roll 14 is absent and roll 20 lies directly above roll 12. Both rolls 12 and 20 are carried on low friction bearings 62. The nip force at nip point 64 is adjusted using a conventional roll gap controller 66.

Figure 2:
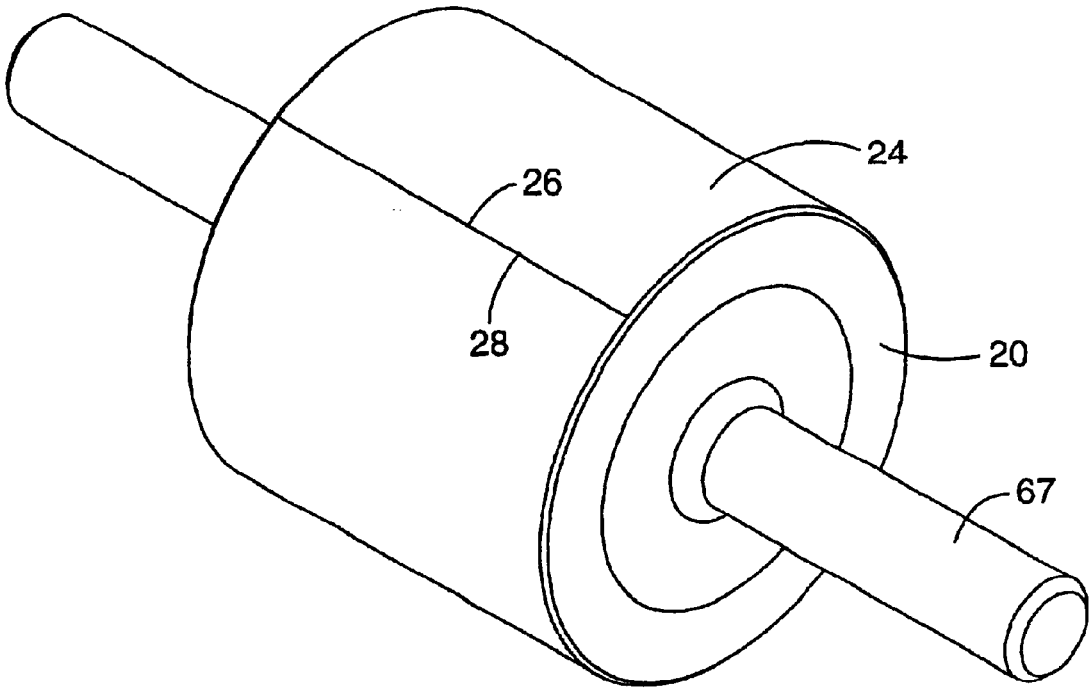
FIG. 2 is a perspective view of a sheet of limited length mounted upon a rotatable support.

FIG. 2 is a perspective view of a sheet 24 of limited length mounted upon rotatable mounting roll 20. As shown in FIG. 2, the ends 26, 28 of sheet 24 are placed in abutting relationship. However, the ends 26, 28 can overlap as shown in FIG. 1*a* and FIG. 1*b* or can have a small gap between them if desired. Axle 67 supports roll 20 on bearings 62, and collars 65 hold bearings 62 in place.

Figure 3:
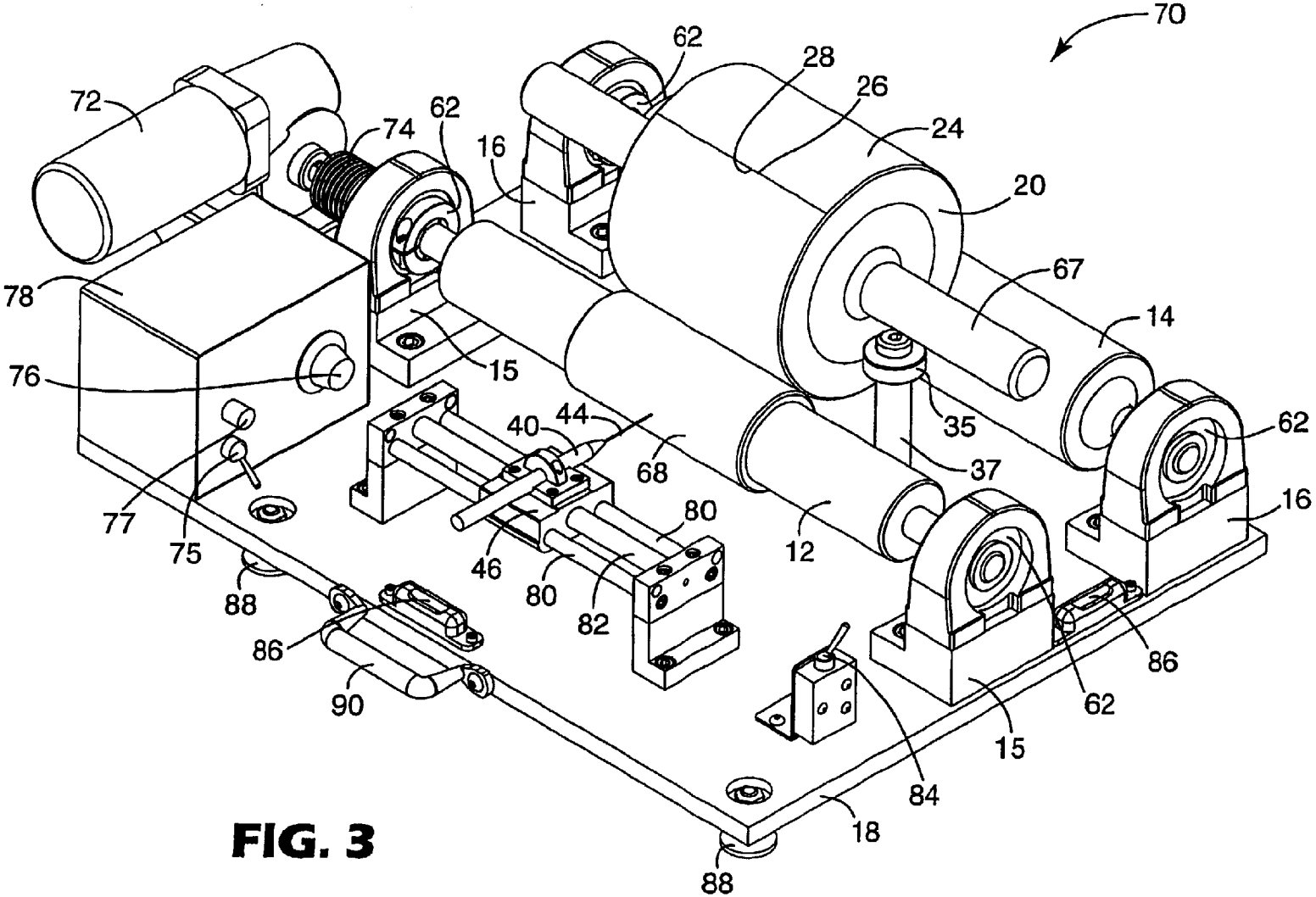
FIG. 3 is a perspective view of a device of the invention.

FIG. 3 is a perspective view of a device 70 of the invention. Device 70 is like device 10 of FIG. 1*a*, but is designed so that the coating liquid is applied to roll 12 rather than to sheet 24 on roll 20. Device 70 is portable and can be used, for example, on a benchtop. Roll 20 is temporarily supported on a docking station formed from pedestal arms 68. Use of the docking station makes it easier to apply a sheet to the rubber face 22 of roll 20. Once the sheet has been applied, roll 20 can be lifted from the docking station by grasping axle 67, swinging arms 68 out of the way on rotating support posts 69, and lowering roll 20 so that it rests on the surfaces of rolls 12 and 14. Rolls 12 and 14 are carried by low friction bearings 62 in pedestals 15 and 16, respectively. Rotating force is supplied to roll 12 by variable speed drive motor 72 operating through a drive belt (not visible) under guard 74. The speed of rotation of motor 72 (and thence of roll 12) is controlled using potentiometer 78 in housing 76. Oscillating mechanism 46 slides back and forth along rails 80 due to the action of spiral wound lead screw 82. The speed of oscillation of slide 46 is controlled by potentiometer 84. Power switch 86 controls the supply of power to device 70. Handle 88 enables device 70 to be moved by hand from place to place. Leveling screws 90 on base 18 enable leveling of device 70.

The basic principles of operation of the devices shown in FIG. 1*a* through FIG. 3 are described in detail in the above-mentioned U.S. patent application Ser. No. 09/757,955 filed Jan. 10, 2001, and in pending U.S. patent application Ser. No. 10/004,237 filed even date herewith and entitled COATING DEVICE AND METHOD USING PICK-AND-PLACE DEVICES HAVING EQUAL OR SUBSTANTIALLY EQUAL PERIODS, the entire disclosure of which is incorporated by reference herein.

Sample sheet coating can be accomplished using the devices of the invention by initially mounting sheet 24 on roll 20 using a suitable mounting technique. If sheet 24 has suitable dielectric properties, then static electrical forces usually will be sufficient to hold sheet 24 in place without other fastening measures being required. Next, roll 20 is placed adjacent contacting roll 12 and other contacting rolls such as roll 14 if present, so that sheet 24 is nipped between roll 20 and the contacting roll or rolls.

The total volume of coating liquid needed to achieve the desired coating caliper can be calculated in advance. Assuming equal film splits at the nip points, e.g., the nip points 32 and 34 in FIG. 1*a*, the total coating liquid volume will equal the desired caliper times the wetted surface area. This wetted surface area will equal the wetted surface of all the contacting rolls, e.g., rolls 12 and 14 plus the wetted surface on roll 20. The desired volume of coating liquid is next applied as one or a plurality of liquid stripes across the length of at least one of the contacting rolls, e.g., roll 12 or roll 14, or across the face of sheet 24 on roll 20. The coating liquid application can conveniently be carried out by flowing the coating liquid through nozzle 44 while nozzle 44 traverses back and forth. By varying the number of stripes and the flow rate from nozzle 44, the desired final caliper on sheet 24 can be very accurately controlled. The applied coating liquid stripes can be placed in random or in specific locations on a contacting roll or rolls or on sheet 24. Improved uniformity for a set number of rotations may be achieved if the stripe width and placement are optimized as described in more detail below. Stripe coating is preferred over attempting to apply a uniform coating to a contacting roll or to sheet 24, because it is much easier to apply a nonuniform coating of thicker stripes than to apply a uniform thin coating. The flow rate of the liquid preferably is held constant during application in order to promote good cross web uniformity in the final coating.

The initial lengthwise uneven coating on the contacting roll or on sheet 24 is converted to a uniform coating by causing the various device rolls to revolve for a plurality of revolutions, whereupon wetted and to be wetted surface portions of the sheet 24 and the contacting roll or rolls will contact and re-contact one another at successively different positions. This causes the coating liquid to be picked up from and replaced onto the sheet 24. The coating quickly becomes much more uniform. For example, in the device shown in FIG. 3, when the variable speed drive motor 72 is energized then the contacting rolls 12 and 14 and mounting roll 20 all rotate at approximately the same surface speed. A very uniform caliper coating is obtained by rotating roll 20 for a suitable number of revolutions (e.g., 10 or more, 20 or more or even 100 or more revolutions) and by exercising appropriate control of various factors discussed below. Following completion of the desired number of revolutions, sheet 24 is removed from the device and permitted to dry or harden if required.

Preferably the respective circumferences of rolls 20 and 12 (and the respective circumferences of roll 20 and additional contacting rolls such as roll 14 if present) are not expressed by a fraction in which the numerator and the denominator are integers ranging from one to twenty. However, if the respective roll circumferences are integer multiples, we have found ways to achieve uniformity using the improvement diagrams discussed below. We have also found ways to minimize or reduce the number of roll revolutions needed to achieve uniformity. Investigation of a very large number of operational modes for the devices and methods of the invention has been accomplished through the use of computer modeling.

Figure 4:
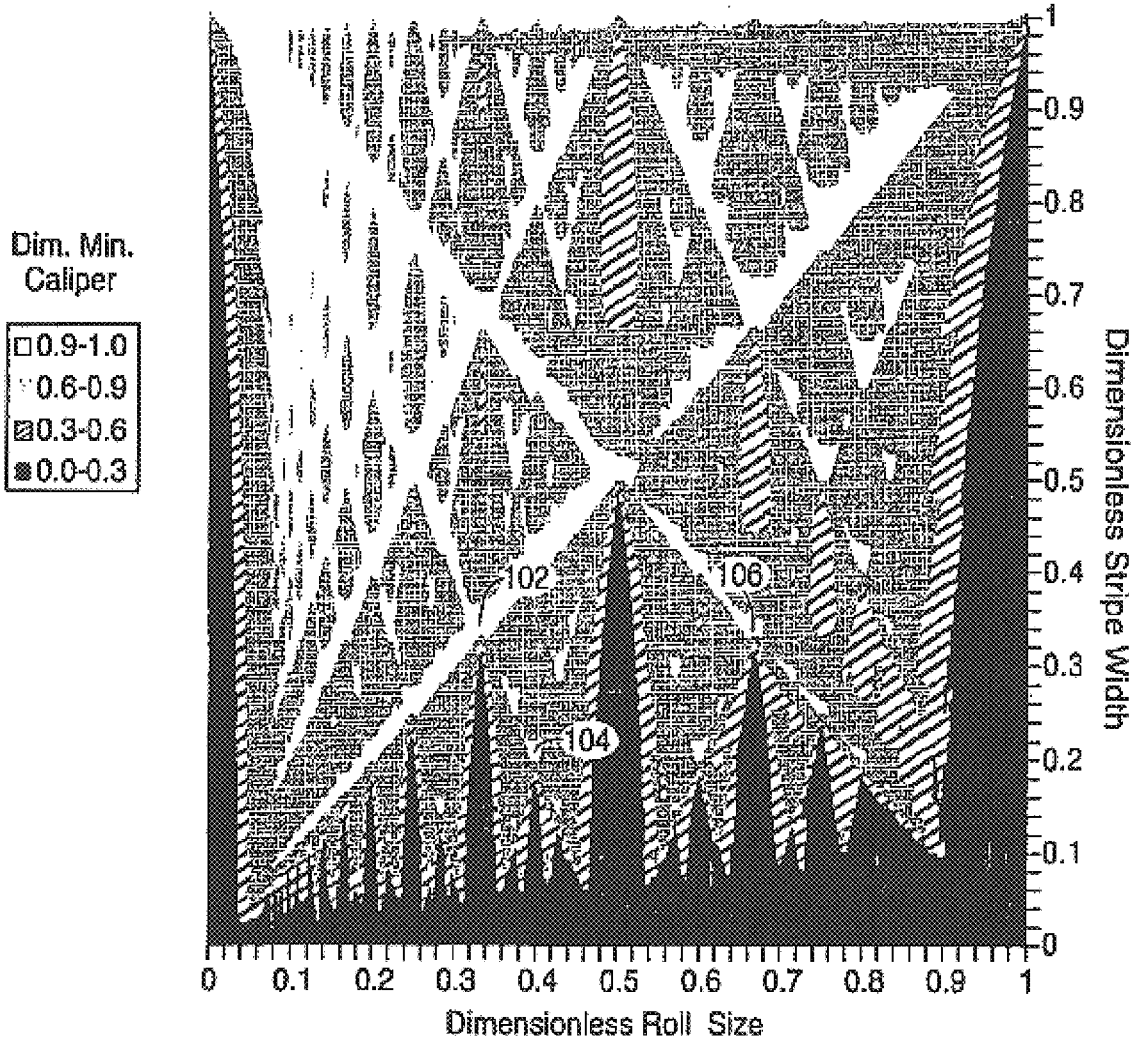
FIG. 4 is an improvement diagram illustrating the minimum caliper that can be obtained by periodically applying cross-web coating stripes to a substrate mounted in a device of the invention having one rotating support and one pick-and-place roll and rotating the support for 20 revolutions, using various dimensionless roll sizes and dimensionless stripe widths.

The improvement diagram in FIG. 4 further illustrates features of our invention. FIG. 4 shows results that can be obtained by applying coating liquid to mounting roll 20 or contacting roll 12 of device 60 in FIG. 1*b* in a variety of operational modes. The modes involve variation in the contacting roll size and the width of an applied stripe of coating liquid. In FIG. 4 and the other improvement diagrams depicted herein, a uniformity metric referred to as the "dimensionless minimum caliper" is calculated by dividing the final minimum coating caliper found on the surface of sheet 24 by the final average coating caliper. The improvement diagram in FIG. 4 is a shaded contour plot. The shadings assigned to various dimensionless minimum caliper ranges are noted in the legend. Black regions represent dimensionless minimum caliper values in the range of 0.3 to 0.6. Black and white-striped regions represent dimensionless minimum caliper values in the range of 0 to 0.3. Gray regions represent dimensionless minimum caliper values in the range of 0.6 to 0.9. White regions represent dimensionless minimum caliper values in the range of 0.9 to 1. A dimensionless minimum caliper value of 0.0 indicates there is at least one uncoated spot on sheet 24 after operation of device 60. A dimensionless minimum caliper value of 1.0 indicates a perfectly uniform coating on sheet 24 after operation of device 60.

It is possible to apply very thick stripes of coating. These will often spread into wider stripes after the first passage through a nip. We define stripe width as the width immediately after the first passage of the stripe through a nip. We also define two dimensionless parameters (referred to in FIG. 4 as the "dimensionless roll size" and "dimensionless stripe width") by dividing the actual contacting roll 12 circumference and the actual stripe width by the actual roll 20 circumference. Every point on the improvement diagram of FIG. 4 thus represents a dimensionless roll 12 circumference and a dimensionless stripe width for the application of a single stripe of coating liquid and operation of device 60 for 20 revolutions. FIG. 4 shows the results for combinations of dimensionless roll 12 sizes from 0 to 1 and dimensionless stripe widths from 0 to 1. Any point location on the improvement diagram represents a pair of choices for these variables. The shading at that point location represents the attained dimensionless minimum caliper. White regions in FIG. 4 thus represent operating conditions where the combination of roll 12 size and applied stripe width results in "good uniformity" (viz., a dimensionless minimum coating caliper greater than 0.9) across the coated face of sheet 24. Black or black and white-striped regions in FIG. 4 represent operating conditions where the combination of roll 12 size and applied stripe width results in one or more voids or near voids on the coated face of sheet 24.

While poor choices and impractical stripe widths dominate most of the areas of the improvement diagram for this simple two roller device, surprisingly good choices of roll size and stripe width are found in FIG. 4. Examples include regions 102, 104 and 106 in FIG. 4.

Figure 5:
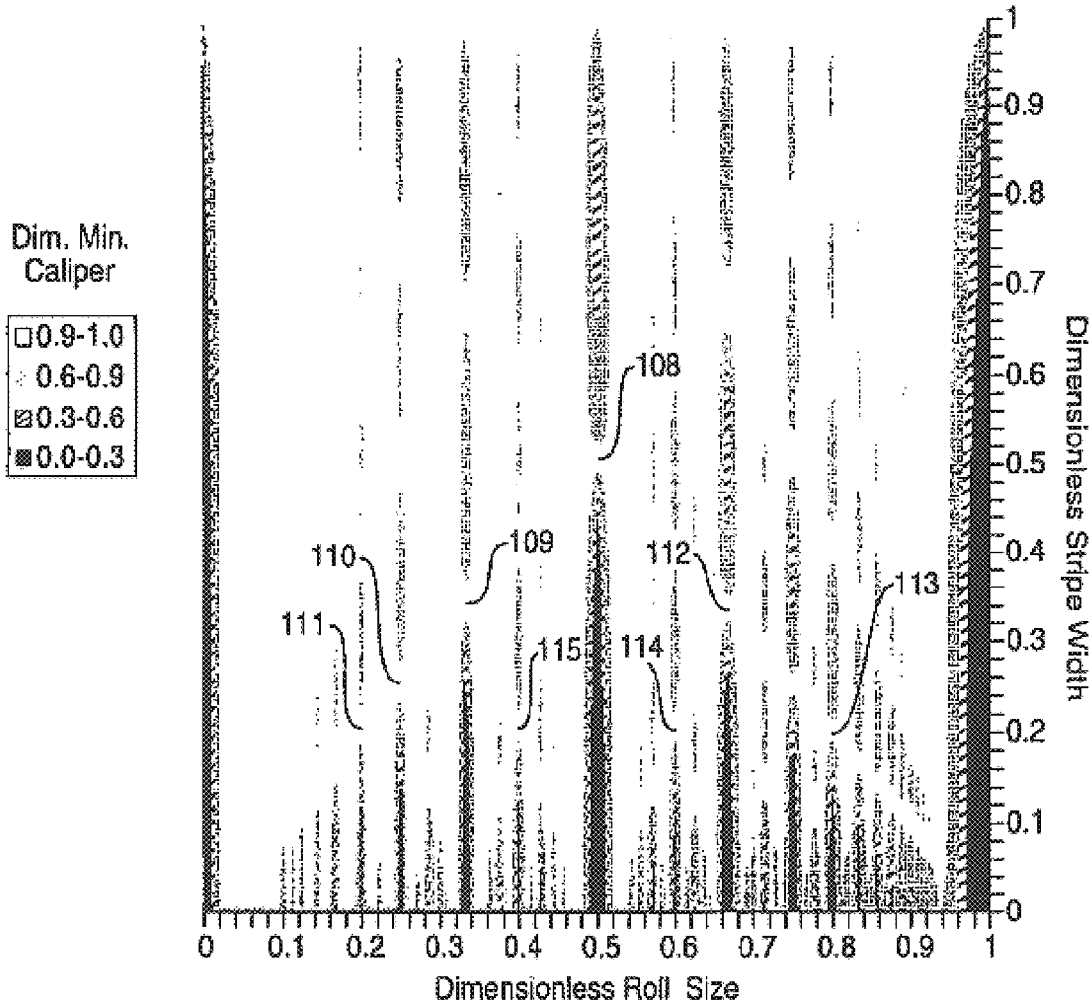
FIG. 5 is an improvement diagram like that of FIG. 4, but after 200 revolutions.

Roll 12 sizes that are integer multiples and proper fractions of the roll 20 size preferably are avoided unless an appropriate value of stripe width is chosen and an adequate number of roll 20 revolutions is used. FIG. 5 is an improvement diagram showing the results obtained for a two roll device (roll 20 plus roll 12) after 200 revolutions of roll 20. The improvement diagram in FIG. 5 has much larger white regions than the improvement diagram in FIG. 4, illustrating the beneficial effect of operating the devices of the invention for a greater number of revolutions. Operating conditions in FIG. 5 in which roll 20 is 1, 2, 3, 4, 5, 6, 7, 8, 9, or 10 times larger than roll 12 are not desirable. These correspond to dimensionless roll 12 sizes of 1, ½, ⅓, ¼, ⅕, ⅙, ⅐, ⅛, ⅑, and 1/10 and are shown as a black, black and white-striped or gray vertically-extending regions in FIG. 5. Other dimensionless roll 12 sizes are also undesirable, such as those shown by the other light gray and black areas in FIG. 5. For example, dimensionless roll sizes corresponding to fractional ratios of ⅖, ⅔ and ⅔ are also undesirable along with roll sizes corresponding to the fractional ratios ⅗, ⅜, ⅜, 3/10 and 3/11.

While the above-mentioned roll sizes are undesirable, in special cases good uniformity can be obtained for these roll sizes when the stripe width equals a special value, called the "minimum dimensionless stripe width". An integer multiple of this value also produces good uniformity. Examples of such minimum dimensionless stripe widths are illustrated on FIG. 5 as regions 108, 109, 110, 111, 112, 113, 114 and 115. These can give good uniformity at dimensionless roll sizes of ½, ⅓, ¼, ⅕, ⅔, ⅘, ⅗ and ⅖, respectively even though operation above or below these stripe width ranges may not.

FIG. 5 illustrates results obtained using a relatively large number of revolutions. However, in appropriate cases thousands or even tens of thousands of revolutions can be employed, so long as the coating liquid is not constrained by factors that would prevent long running times. Drying, curing, gelation, crystallization or a phase change occurring with the passage of time may impose limitations. If the coating liquid contains a volatile component, the time necessary to achieve hundreds or thousands of revolutions may allow drying to proceed to the extent that the liquid may solidify. A phase change for any reason while the rolls are rotating usually results in disruptions and patterns in the applied coating. Therefore, it is generally preferable to produce the desired degree of coating uniformity in as few revolutions as possible.

For industrial coating applications, we prefer to use dimensionless stripe widths that are less than about 0.2, and more preferably between about 0.05 and about 0.15. In general, narrow stripe widths are easier to produce than wider stripe widths. However, wider stripe widths (e.g., widths greater than about 0.2) can be used if desired.

When stripe width ratios of 0.1 to 0.2 can be applied, one preferred range of choices for the dimensionless roll 12 size in FIG. 5 lies between 0.205 and 0.24, or generally between the fractions ⅕ and ¼. Other preferred dimensionless roll 12 size ranges for these and wider stripe width ratios would have a size between 0.02 to 0.195, 0.255 to 0.28, 0.34 to 0.36 and 0.44 to 0.48.

Through extensive investigations, we have found the following generalizations. For every dimensionless roll 12 size that equals an proper fraction (e.g., dimensionless roll sizes such as ½, ⅖, 11/20) there exists a minimum dimensionless stripe width less than 1.0, such that good uniformity will be obtained if sufficient revolutions of roll 20 are used. The exception is for the fractions n/1 where n is an integer. Exceeding the minimum dimensionless stripe width may result in but is not sufficient to insure good uniformity. For any given fractional roll size, good uniformity will only be obtained if a sufficient number of revolutions of roll 20 have occurred. Likewise, after any fixed number of revolutions, only a limited range of stripe ratios provide good uniformity.

Knowledge of the existence of these minimum dimensionless stripe widths allows an appropriate stripe width to be selected when the dimensionless roll size choices are restricted. Likewise, this knowledge often allows a desired caliper to be obtained at a given dimensionless roll size by choosing narrower or wider stripe widths from amongst a set of available stripe width choices. When such sets exist, then the more easily produced narrower stripe widths can be selected in preference to wider stripe widths.

A value we describe as the "dimensionless range minimum" (defined as the lowest dimensionless minimum caliper found when the dimensionless stripe width varies from 0.05 to 0.15) can be used to select a preferred range of dimensionless roll sizes. This range is especially preferred for industrial use, but should not be considered a constraint Operation outside the dimensionless range minimum is acceptable as well.

Figure 6:
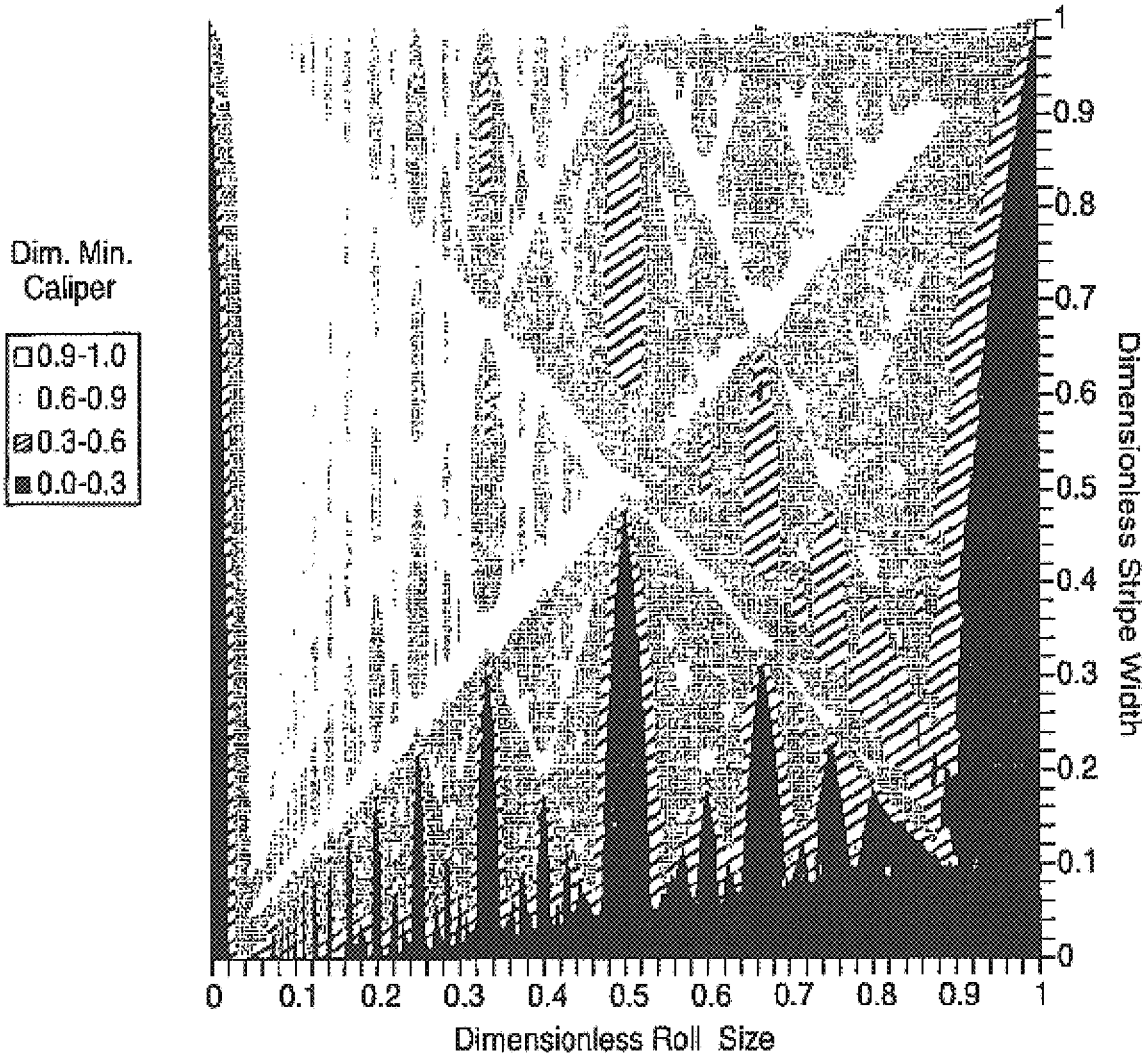
FIG. 6 is an improvement diagram like that of FIG. 4, but for a device of the invention having one rotating support and two pick-and-place rolls.
Figure 7:
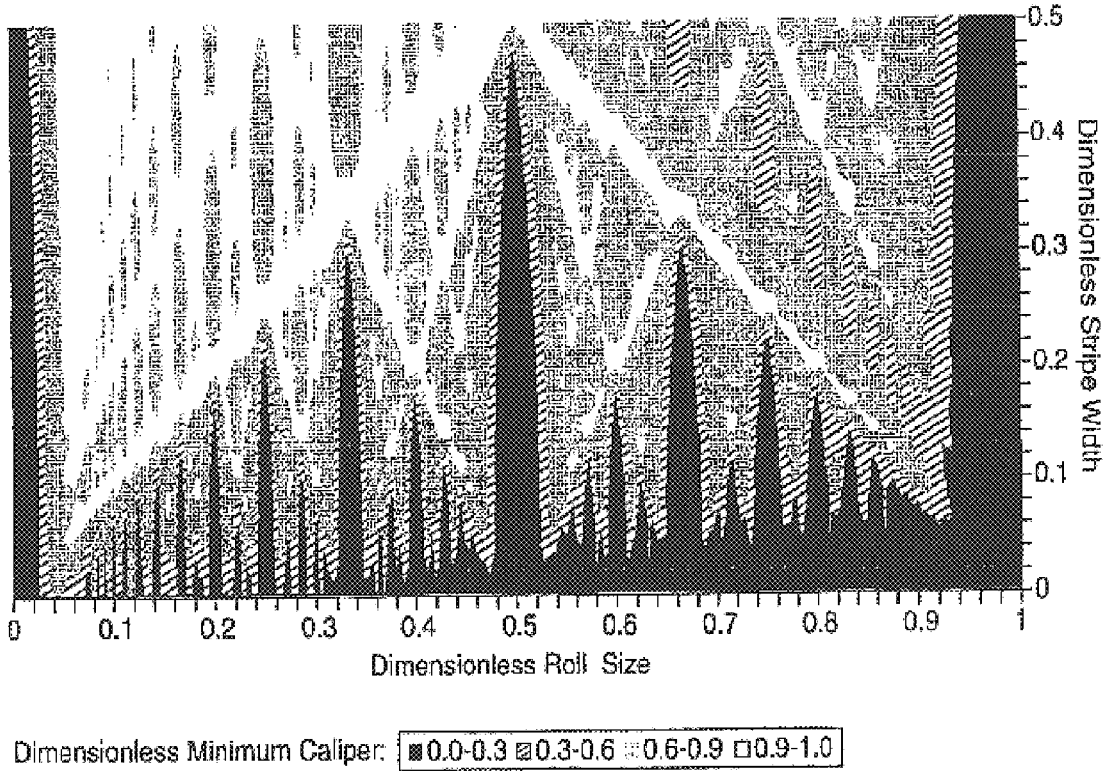
FIG. 7 is an improvement diagram like that of FIG. 4, but after 40 revolutions.

By employing more rolls than just roll 12 bearing against mounting roll 20, an expanded range of regions with good coating caliper is obtained. FIG. 6 is an improvement diagram for 20 revolutions for a three roll device (roll 20 plus rolls 12 and 14) such as is shown in FIG. 1*b* where rolls 12 and 14 are of equal size. Comparison of FIG. 4 and FIG. 6 shows enlarged or new regions of good coating caliper, especially for dimensionless roll sizes below 0.5. However, if the dimensionless stripe width is limited to between 0.05 and 0.15, there is only a modest expansion of the preferred white regions on the contour plot in FIG. 6. One might expect that for small rolls the results obtained using two contacting rolls (viz., a three roll device) would be equivalent to those obtained by running one roll (viz., in a two roll device) for twice as many roll 20 revolutions. FIG. 7 shows the results obtained in a two roll device after 40 revolutions of roll 20. It should be noted that the vertical axis of FIG. 7 shows dimensionless stripe widths only from 0 to 0.5. Comparison of FIG. 6 and FIG. 7 shows that it is actually better to use a two roll device having only one contacting roll for 40 revolutions of roll 20, than to use a three roll device employing two equal size contacting rolls for 20 revolutions of roll 20.

Figure 8:
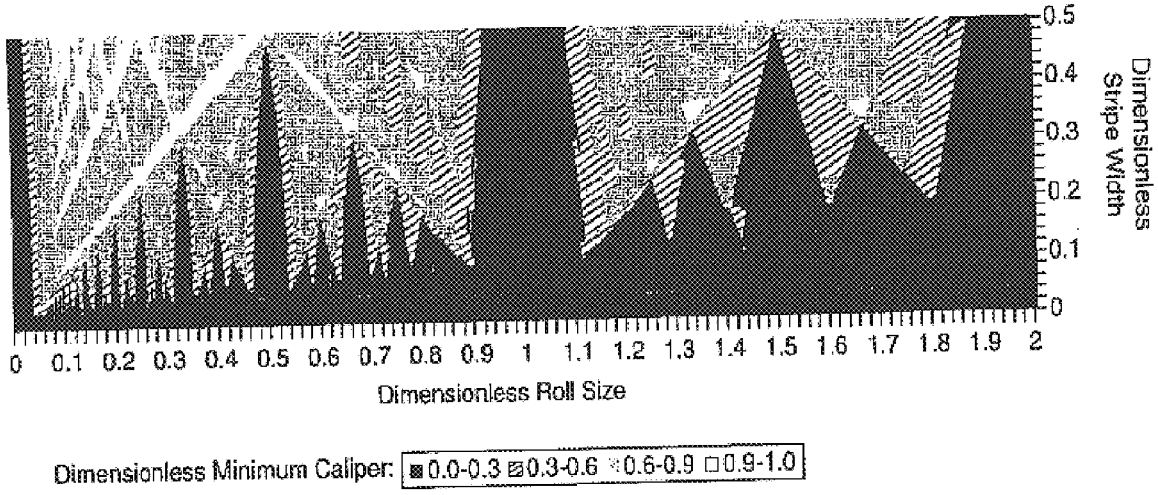
FIG. 8 is an improvement diagram like that of FIG. 4, with an expanded horizontal axis.
Figure 9:
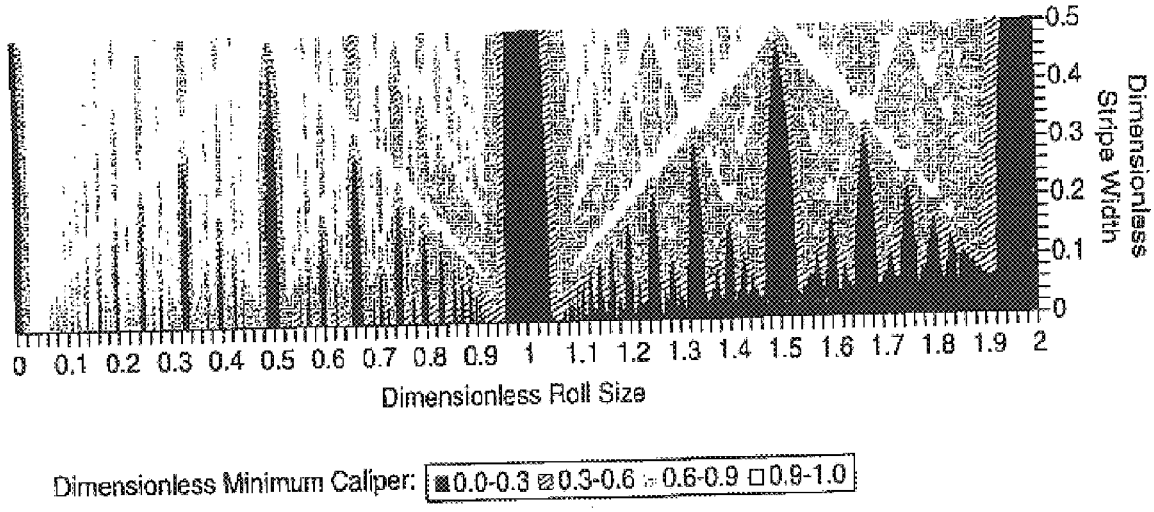
FIG. 9 is an improvement diagram like that of FIG. 8, but after 100 revolutions.

FIG. 8 and FIG. 9 show improvement diagrams for 20 and 100 revolutions of roll 20 in the two roll device of FIG. 1*a*. Both diagrams employ an expanded range of dimensionless roll size ratios (from 0 to 2) and a reduced range of dimensionless stripe widths (from 0 to 0.5). Comparison of FIG. 8 and FIG. 9 shows that dimensionless roll 12 size ratios less than 1.0 are preferred over ratios greater than 1.0. However, good uniformity can be obtained using ratios larger than 1.0 if a greater number of roll 20 revolutions is used.

Further performance improvements can be obtained by operating the contacting rolls at different speeds using a fixed or variable constant speed differential. The rotational period of the surface of a rotating body relative to another rotating body can also be changed by varying the size of the first body while holding its surface speed constant (e.g., by inflating or deflating or otherwise expanding or shrinking the roll). If the roll is constructed from a thermally expanding material, then the roll size (and the roll period) can also be modified by operating the roll at differing temperatures. Also, the position of a roll can be varied during operation. For example, a force can be applied to the end of and parallel to shaft 67 of roll 20 to cause roll 20 to oscillate back and forth relative to the contact faces of the rolls 12 and 14. This movement will induce sideways, cross-sheet movement of liquid and improve overall coating uniformity, especially if the initially applied stripe was not perfectly uniform. All of the above variations are useful, and all can be used to affect and improve the performance of the devices and methods of the invention and the uniformity of the caliper of the finished coating.

Very small variations in relative roll surface periods or surface speeds have been found to be useful. Variation can be accomplished, for example, by independently driving the rolls with separate motors and electrically varying the motor speeds. Those skilled in the art will appreciate that a variety of mechanical speed variation devices can also be employed, including variable speed transmissions, belt and pulley or gear chain and sprocket systems in which a pulley or sprocket diameter is changed, and limited slip clutches or braking to slow the rotation of a roll. A variety of speed variation functions can be employed, e.g., random or controlled variations, including variations having a periodic or non-periodic nature, random walks, linear ramp functions in time and intermittent changes. All can be used to lessen the number of revolutions of roll 20 required to produce uniform coating on a sheet. A preferred mode of speed variation is to vary the surface speed differential between a contacting roll and roll 20 sinusoidally as roll 20 is revolved. Improved results are obtained with small speed variations having amplitudes as low as 0.5 percent of the average. Often it is desirable to avoid larger amplitude variations, especially when large numbers of revolutions of roll 20 are employed, in order to avoid heat generation from excessively high speed differentials.

Preferably when two or more contacting rolls are employed, the contacting rolls have rotational periods that are different from one another and even more preferably are not periodically related to one another. This can conveniently be accomplished by selecting contacting rolls having appropriately chosen different diameters. The period of a contacting roll can be varied in other ways including dynamically changing the roll surface speed, diameter or position as described above.

Figure 10:
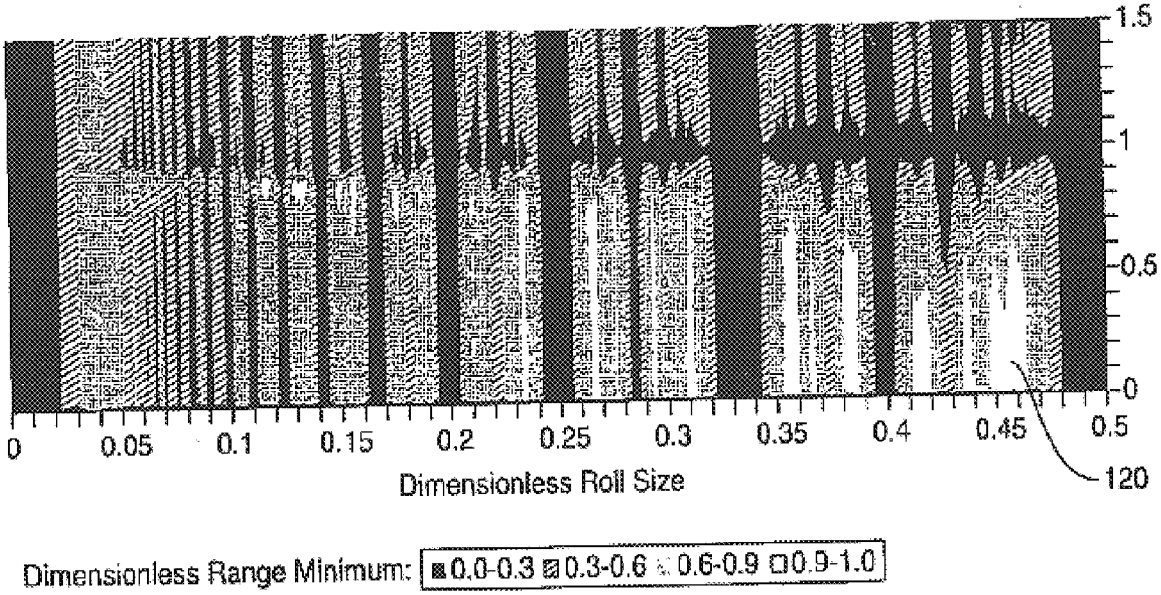
FIG. 10 is an improvement diagram illustrating the dimensionless range minimum as a function of roll size for 2% speed variations of the pick-and-place rolls.

When the period of a contacting roll is dynamically varied, the preferred period for the variation is longer than the period of revolution for roll 20. We define the "dimensionless relative speed period" for a contacting roll and roll 20 as the period of the relative speed differential between the contacting roll and roll 20 divided by the nominal period of rotation of roll 20. The dimensionless relative speed period will depend upon the chosen dimensionless roll size and stripe width. In general, improved performance for dimensionless stripe widths in the range of 0.05 to 0.15 will be obtained when the reciprocal of the dimensionless relative speed period is between 0.02 and 0.3. FIG. 10 plots the dimensionless range minimum. FIG. 10 illustrates the influence after 20 revolutions of a single contacting roll in a device like that of FIG. 4 when a 2% sinusoidal speed variation is imparted to the contacting roll. This speed variation converts regions that previously provided voids or poor caliper uniformity into regions of good caliper uniformity (e.g., the region 120 in FIG. 10). Similar speed variations can be employed in devices containing two or more contacting rolls. Improved performance is obtained in such devices when the periodic variations are not synchronized. For example, when two contacting rolls are employed, periodic variations that are 180 degrees out of phase are preferred.

Figure 11:
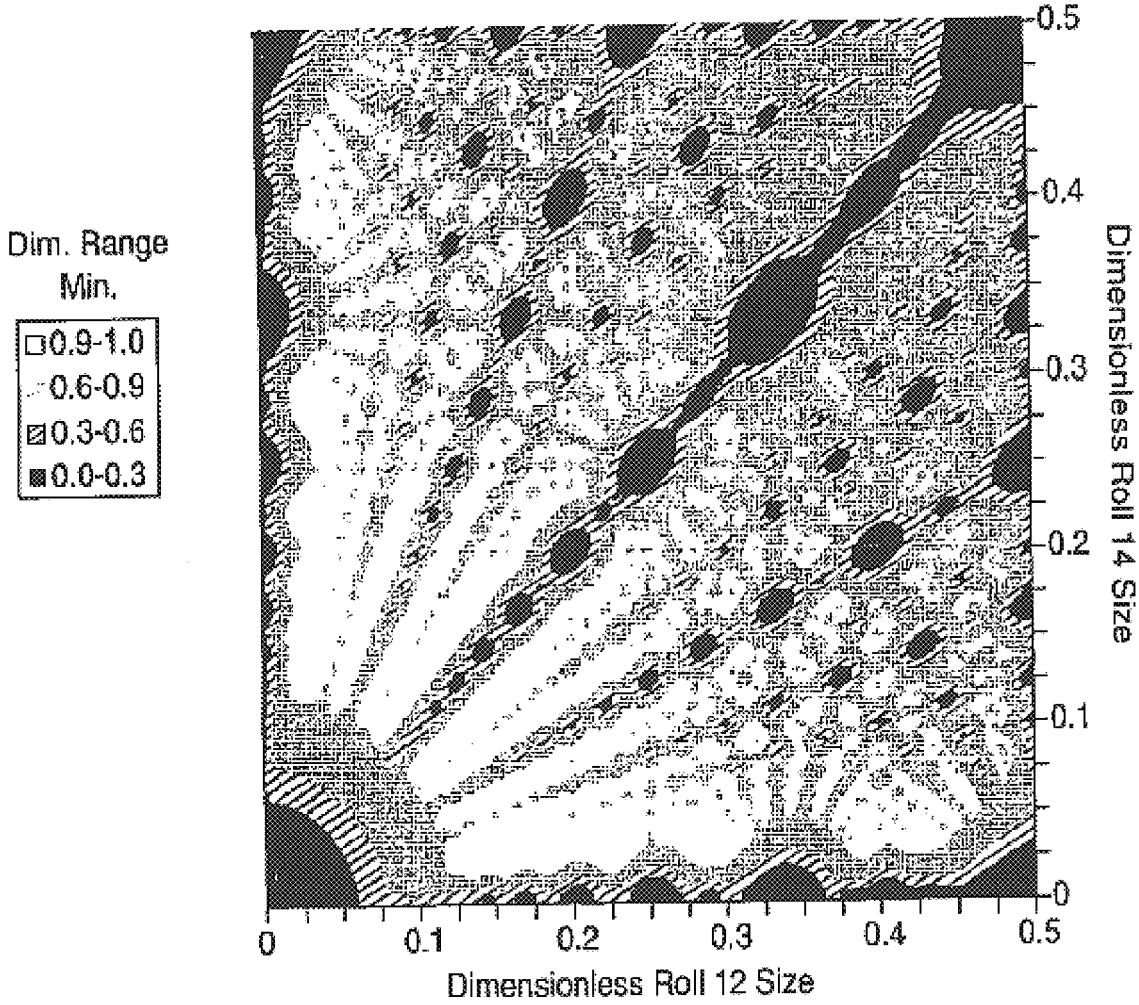
FIG. 11 is an improvement diagram illustrating the dimensionless range minimum that can be obtained by periodically applying a cross-web coating stripe of constant dimensionless stripe width to a substrate mounted in a device of the invention having one rotating support and two pick-and-place rolls and rotating the support for 10 revolutions, using various dimensionless roll sizes for the two pick-and-place rolls.
Figure 12:
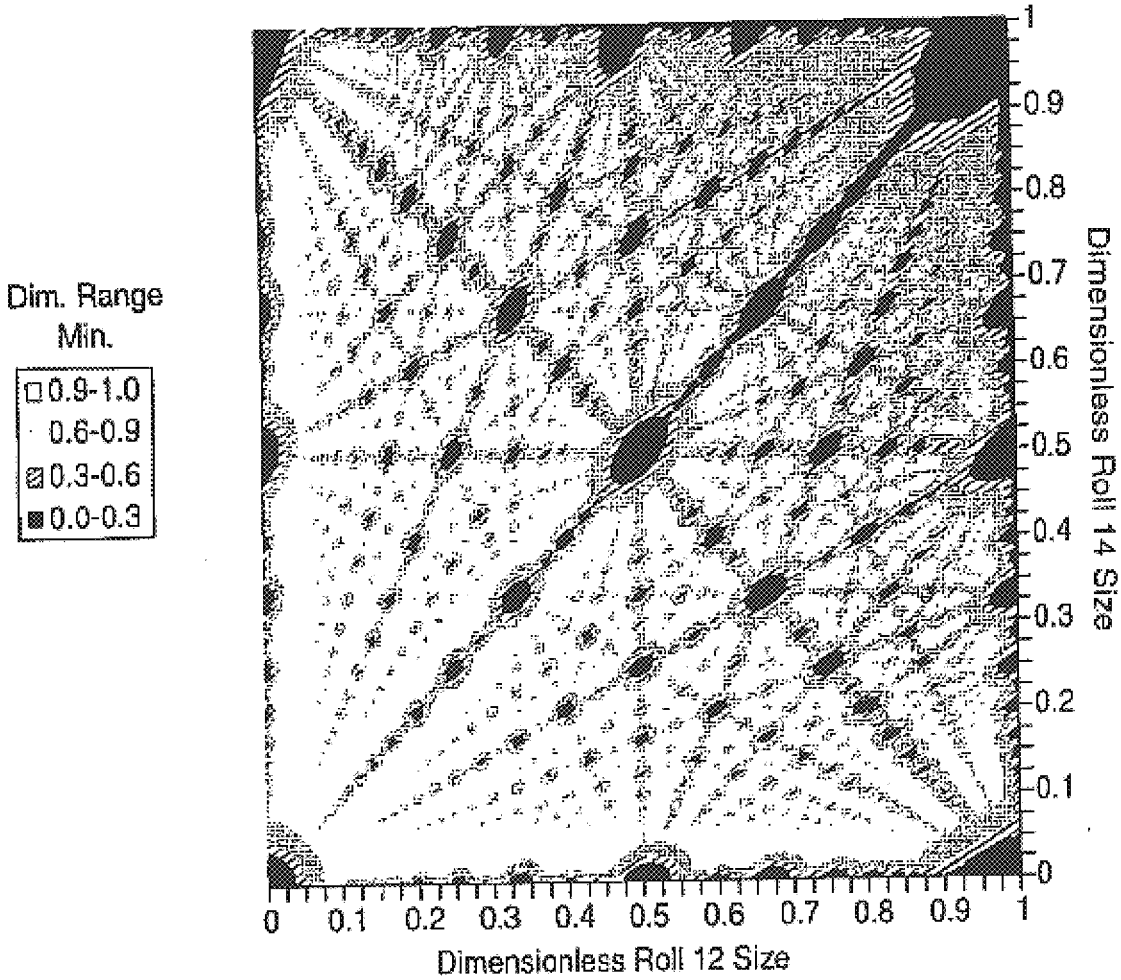
FIG. 12 is an improvement diagram like that of FIG. 11, but after 20 revolutions.

A three roll apparatus in which two differently-sized contacting rolls act upon the sheet 24 can produce especially good coatings with dimensionless range minimums near 1.0 after only a few revolutions. In general, fewer revolutions of the mounting roll 20 are required in such devices than when only a single roll 12 or two equally-sized rolls 12 and 14 are employed. FIG. 11 and FIG. 12 are improvement diagrams for a three roll apparatus using rolls 12 and 14 of varying sizes. FIG. 11 and FIG. 12 are constructed differently from the previous improvement diagrams. The contour value of any point on the diagrams in FIG. 11 and FIG. 12 gives the dimensionless range minimum defined above. The X axis represents the dimensionless roll 12 size and the Y axis represents the dimensionless roll 14 size.

Islands of poor performance are centered about abscissa and ordinate values equal to integer fractions u/v where u and v are integers. The size of an island is locally proportional to the lowest common denominator of the abscissa and ordinate of its center point expressed as fractions. Bands of relatively poor performance emanate from each axis along straight lines where the axis values are fractions. The lines are described by the family of equations $y=(s/t)x+u/v$ where s, t, u, and v all are positive or negative integers and where y is the ordinate and x the abscissa. As shown in FIG. 11, there are multiple regions (white regions on the improvement diagram) corresponding to roll size combinations that will produce good caliper uniformity in only 10 revolutions. As shown in FIG. 12, the range of choices increases when 20 revolutions are employed. FIG. 11 and FIG. 12 confirm that very simple roll devices can be used to obtain uniform functional coatings on sheets. They identify combinations of roll sizes to use and sizes to avoid for a desired level of coating performance.

Figure 13:
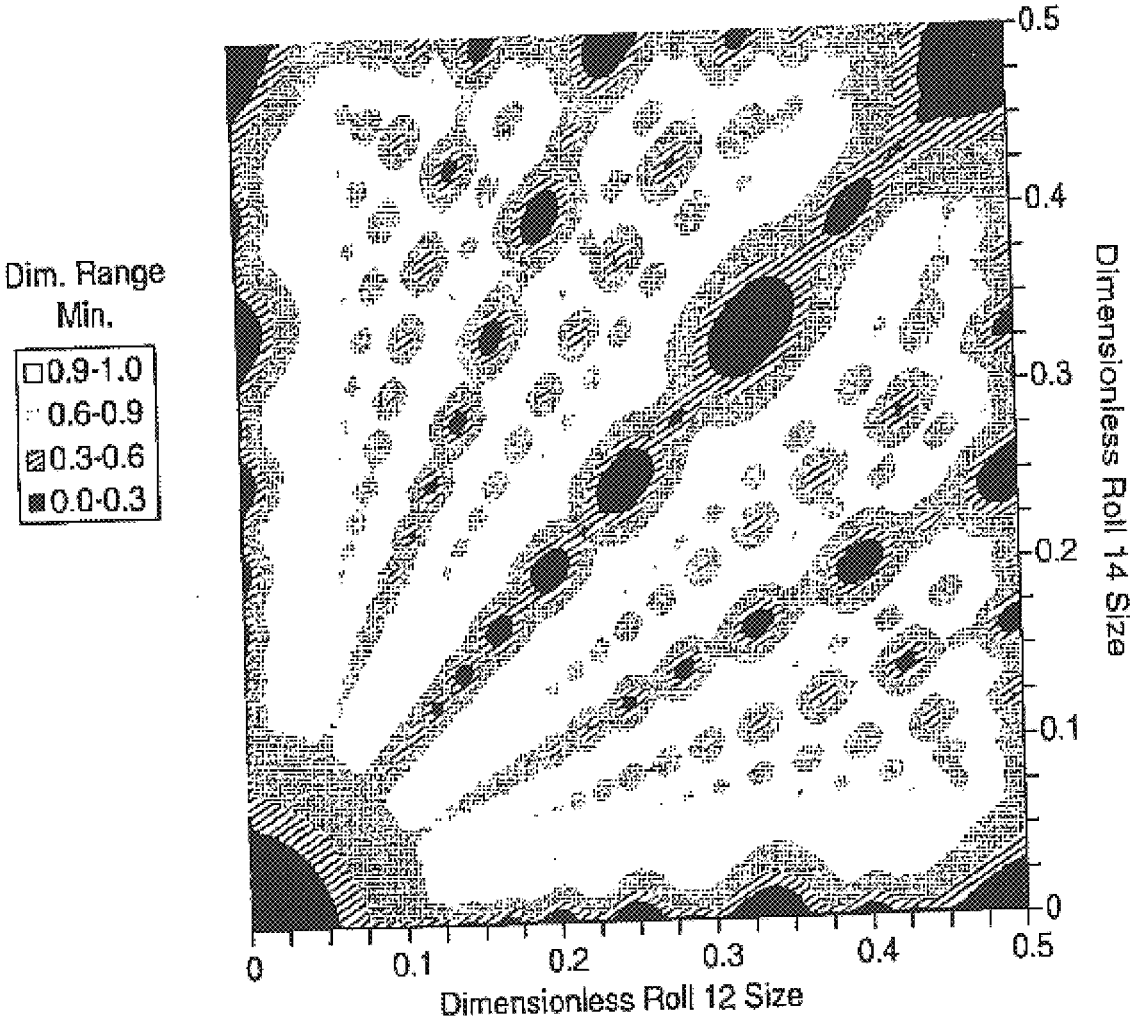
FIG. 13 is an improvement diagram like that of FIG. 11, but with a 2% variation in relative roll speeds.

Comparison of FIG. 11 and FIG. 13 further demonstrates the improvements created by speed differentials. FIG. 13 shows the results for a three roll device after 10 revolutions when two sinusoidal differentials are employed that are 180 degrees out of phase and that have amplitudes of 2 percent of the average mounting roll period. The use of even these small differentials dramatically increases the area of the white regions on the improvement diagram.

The coating liquid can be applied in a variety of uneven patterns other than stripes, and by using methods other than the oscillating needle applicator shown in FIG. 1. For example, a pattern of droplets can be sprayed onto roll 12 or sheet 24 using a suitable non-contacting spray head or other drop-producing device. Examples of suitable drop-producing devices include point source nozzles such as airless, electrostatic, spinning disk and pneumatic spray nozzles. Line source atomization devices are also known and useful. The droplet size may range from very large (e.g., greater than 1 millimeter) to very small. The nozzle or nozzles can be oscillated back and forth across the substrate, e.g, in a manner similar to the above-described needle applicator. Particularly preferred drop-producing devices are described in the above-mentioned U.S. patent application Ser. No. 09/841,380, and in pending U.S. patent application Ser. No. 09/841,381 filed Apr. 24, 2001 and entitled VARIABLE ELECTROSTATIC SPRAY COATING APPARATUS AND METHOD, (now U.S. Pat. No. 6,579,574 B1), the entire disclosure of which is incorporated by reference herein.

The benefits of the present invention can be tested experimentally or simulated for each particular application. Many criteria can be applied to measure coating uniformity improvement. Examples include caliper standard deviation, ratio of minimum (or maximum) caliper divided by average caliper, range (defined as the maximum caliper minus the minimum caliper over time at a fixed observation point), and reduction in void area. For example, through the use of the present invention, range reductions of greater than 75%, greater than 80%, greater than 85% or even greater than 90% can be obtained. For discontinuous coatings (or in other words, coatings that initially have voids), the invention enables reductions in the total void area of greater than 50%, greater than 75%, greater than 90% or even greater than 99%. The application of this method can produce void-free coatings. Those skilled in the art will recognize that the desired degree of coating uniformity improvement will depend on many factors including the type of coating, coating equipment and coating conditions, and the intended use for the coated substrate.

Through the use of the invention, 100% solids coating compositions can be converted to void-free or substantially void-free cured coatings with very low average calipers. For example, coatings having thicknesses less than 5 micrometers, less than 1 micrometer, less than 0.5 micrometer or even less than 0.1 micrometer can readily be obtained. Coatings having thicknesses greater than 5 micrometers can also be obtained. In such cases it may be useful to groove, knurl, etch or otherwise texture the surfaces of the contacting rolls so that they can accommodate the increased wet coating thickness.

A coating having random or periodic areas that are deficient in coating material can be analyzed by considering the coating to be made up of a uniform base coating underneath a voided coating of the same composition. The devices described herein will act to remove and reposition the top voided coating in a manner similar to their action on a lone voided coating. Thus the teachings provided herein for a voided coating also apply to a non-voided but non-uniform coating containing coating depressions. In a similar manner periodic or random excesses in a coating can be analyzed by considering the coating to be made up of a uniform base coating underlying a discontinuous top coating. Thus the teachings provided herein for a voided coating also apply to a non-voided but non-uniform coating containing coating surges.

Another aspect of the invention is that the devices and methods of the invention increase the rate of drying volatile liquids on a substrate. Drying is often carried out after a substrate has been treated by washing or by passage through a treating liquid. Here the main process objective is not to apply a liquid coating, but instead to remove liquid. For example, droplets, patches or films of liquid are commonly encountered in operations such as plating, coating, etching, chemical treatment, printing and slitting, as well as washing and cleaning in the electronics industry. When a liquid is placed on or is present on a substrate in the form of droplets, patches, or coatings of varying uniformity and if a dry substrate is desired, than the liquid must be removed. This removal can take place, for example, by evaporation or by converting the liquid into a solid residue or film. In industrial settings drying usually is accomplished using an oven. The time required to produce a dry substrate is constrained by the time required to dry the thickest caliper present. Conventional forced air ovens produce uniform heat transfer and do not provide a higher drying rate at locations of thicker caliper. Accordingly, the oven design and size must account for the highest anticipated drying load.

The devices and methods of the invention greatly increase the rate of substrate drying, and substantially reduce the time required to produce a dry substrate. Without intending to be bound by theory, the repeated contact of the wet coating with the contacting roll or rolls is believed to increase the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the contacting roll or rolls to the wet substrate may help break up rate limiting boundary layers near the liquid surface of the wet coating. All of these factors appear to aid in drying.

The devices and methods of the invention can be used to apply, make more uniform or dry coatings on a variety of flexible or rigid substrates, including paper, plastics, glass, metals and composite materials. The substrates can have a variety of surface topographies including smooth, textured, patterned, microstructured and porous surfaces (e.g., smooth films, corrugated films, prismatic optical films, electronic circuits and nonwoven webs). The substrates can have a variety of uses, including tapes, membranes (e.g., fuel cell membranes), insulation, optical films or components, electronic films, components or precursors thereof, and the like. The substrates can have one layer or many layers under the coating layer. The invention is especially useful for quickly evaluating a series of coated substrates prior to scale-up of large-scale web manufacturing processes. The invention is also useful for preparing calibration standards, and for modifying the optical, chemical, mechanical or electrical properties of a sheet surface without resorting to hand spreads or to extreme dilution of a coating formulation with solvents or water. The invention is especially useful in view of the extremely thin coating calipers that can be achieved.

The invention is further illustrated in the following examples, in which all parts and percentages are by weight unless otherwise indicated.

EXAMPLES 1–9

Using a coating device like that shown in FIG. 3 (but designed so that the roll 14 rather than the roll 12 would be electrically driven), a series of coated sheets was produced by applying a modified lubricant oil to biaxially oriented polypropylene film ("BOPP") sheets. The BOPP sheets were obtained as a 152 mm wide continuous web that had been corona treated and cut into rectangular pieces. The coating device mounting roll had a 203 mm wide face width, a 305 mm diameter and a surface covered with oil resistant Buna-N rubber having a hardness of 52 on the Shore A scale. The rectangular BOPP pieces were cut to lengths that would wrap around the mounting roll with an overlap of 13 to 51 mm at the ends of the cut sheets (viz., 152 mm wide× 970–1008 mm long).

The coating device had two steel pick-and-place contacting rolls having face widths of 305 mm and respective diameters of 69.24 mm and 52.45 mm. These pick-and-place rolls could be referred to respectively as the primary and secondary rolls. They provided dimensionless roll sizes of 0.07209 and 0.05461, respectively. The primary roll was undercut on each end leaving a 114 mm raised portion in the center. The secondary roll was driven by a DAYTON™ Model 2H530 DC gearmotor controlled using a DAYTON™ Model 4Z527E DC speed controller (both from Dayton Electric Mfg. Co., Niles, Ill.).

The lubricant oil (MOBIL 1™, Exxon Mobil Corp, having a designated viscosity range of 5w–30) was modified by adding a fluorescent organic liquid (9-allyl fluorene) at a concentration of 1 part liquid to 9 parts of oil. Using a syringe pump (model 55-1144 from Harvard Apparatus, South Natich, Mass.), the resulting coating liquid was supplied through flexible 4 mm OD plastic tubing to a flexible plastic needle mounted upon the carriage block of a UNISLIDE™ Model MB2515W2J-S2 ½ translation device (Velmex Inc., Bloomfield, N.Y.) driven by a BODINE™ Model NSH-12R gearmotor (Bodine Electric Co., Chicago, Ill.) and controlled using a BHL DIGISYSTEM™ Model DXT-15VR1.3 motor controller. The needle was 0.86 mm in diameter, and was positioned so that the tip of the needle made contact with the primary roll.

Preparation of a coated sample used the following procedure. With the rubber-covered mounting roll placed in the docking station, a single BOPP sheet was applied with the corona treated side facing outward and centered on the roll. Static electricity held the sheet in place. The resulting sheet-wrapped mounting roll was lifted from the docking station, set atop the primary and secondary rolls of the coating device, and centered with respect to the raised portion of the primary roll.

The applied volume of coating liquid could be varied by altering any one or more of several variables including the discharge rate of the syringe pump, the number of traverses of the needle across the primary roll face, and the needle traverse speed. These variables were adjusted to achieve the desired applied volume of coating liquid as a uniform, continuous ribbon or line of liquid in a single stripe across the primary roll.

After application of the liquid stripe to the primary roll, the secondary roll drive motor was started and the rubber roll rotated at a speed of 125 revolutions per minute for a period of 3 minutes. During rotation, the coating repeatedly transferred back and forth between the contacting rolls and the sheet surface and became uniform in appearance. After a total of approximately 375 revolutions, the rotation was stopped. The rubber roll was carefully removed and placed on the docking station. The coated BOPP sheet was then removed and taped to a cardboard frame for inspection. The volume of applied coating liquid and thus the average liquid caliper on the sheet was calculated by assuming uniform coverage on the primary and secondary rolls and the BOPP sheet at the end of the coating cycle. One or more square samples having dimensions of 38 mm×38 mm were removed from each sheet for fluorescence measurements. The samples were irradiated at a wavelength of 254 nm and fluorescence was measured at 312.66 nm. Set out below in Table 1 are the results of the fluorescence measurements:

TABLE 1

| Example No. | Coating Caliper (micrometers) | Relative Fluorescence Intensity |
|---|---|---|
| 1 | 5.4 | 13.00 |
| 2 | 10.9 | 26.02 |
| 3 | 19.3 | 33.00 |
| 4 | 21.8 | 38.06 |
| 5 | 38.6 | 52.46 |
| 6 | 77.1 | 76.96 |
| 7a | 5.4 | 13.00 |
| 7b | 5.4 | 14.29 |
| 7c | 5.4 | 14.03 |
| 7d | 5.4 | 15.25 |
| 7e | 5.4 | 15.62 |
| 7f | 5.4 | 15.64 |
| 7g | 5.4 | 14.45 |
| 8a | 10.9 | 26.02 |
| 8b | 10.9 | 25.89 |
| 8c | 10.9 | 25.42 |
| 8d | 10.9 | 26.64 |
| 8e | 10.9 | 26.04 |
| 8f | 10.9 | 27.49 |
| 8g | 10.9 | 27.63 |
| 9a | 21.8 | 38.06 |
| 9b | 21.8 | 38.02 |
| 9c | 21.8 | 39.92 |
| 9d | 21.8 | 33.87 |
| 9e | 21.8 | 35.82 |
| 9f | 21.8 | 34.59 |
| 9g | 21.8 | 35.83 |

The coated sheets of Examples 1 through 9 all appeared to have uniform void-free coatings. All coatings were made using a single pass of the applicator needle against the primary roll. The results in Table 1 demonstrate near linear correlation between predicted caliper and fluorescence except at the lowest caliper. Examples 7a through 7g (and likewise Examples 8a through 8g and Examples 9a through 9g) were multiple samples taken from a single sheet. These individual samples demonstrate very good uniformity for the coating method of the invention and the attainment of very low average coating caliper.

EXAMPLES 10–16

Using the device and method of Examples 1–9, a coating liquid formulation containing 65 parts glycerol, 35 parts water, 0.25 parts of a fluorinated wetting agent (3M™ FLUORAD™ FC129, Minnesota Mining and Manufacturing Company, St. Paul, Minn.), and 0.25 parts of an optical brightener (TINOPAL™, Ciba Performance Chemicals) was coated onto BOPP sheets. By using multiple needle traverses across the primary roll, thicker caliper coatings than those formed in Examples 1–9 were obtained. The coating stripes were spaced uniformly around the circumference of the primary roll in lines parallel to the rotational axis of the primary roll by rotating the primary roll slightly between each traverse of the needle. The coated samples were irradiated at a wavelength of 360 nm and fluorescence was measured at 430 nm. The coatings appeared uniform and void-free. Samples were cut from four portions of each sheet. The results are set out below in Table 2.

TABLE 2

| Ex. No. | Number of Needle Passes | Needle Flow Rate (ml/min) | Coating Caliper (micrometers) | Fluorescence Intensity Sample a | Sample b | Sample c | Sample d |
|---|---|---|---|---|---|---|---|
| 10 | 6 | 1.3 | 501.2 | 178.2 | 179.1 | 168.6 | 178.9 |
| 11 | 6 | 0.9 | 347 | 122.9 | 120 | 119.4 | 118.9 |
| 12 | 6 | 0.6 | 231.3 | 84.6 | 82.1 | 83.9 | 83.8 |
| 13 | 6 | 0.2 | 77.1 | 35.7 | 35 | 35 | 35.9 |
| 14 | 5 | 0.05 | 19.3 | 15.3 | 14.8 | 14.3 | 14.3 |
| 15 | 2 | 0.025 | 9.6 | 13.9 | 10.3 | 10.6 | 11.9 |
| 16 | 1 | 0.015 | 5.8 | 9.8 | 8.4 | 9.1 | 8.8 |

As shown in Table 2, there was a very linear correlation between coating and fluorescence intensity. A wide range of coating calipers was achieved by changing the needle flow rate and number of needle passes while holding the needle traverse speed constant. This illustrated one manner in which a wide range of target calipers can easily be obtained.

Various modifications and alterations of this invention will be apparent to those skilled in the art without departing from the scope and spirit of this invention. This invention should not be restricted to that which has been set forth herein only for illustrative purposes.

What is claimed is:

1. A method comprising:

a) providing a rotating support having a surface, the surface at least partially covered with a removable substrate of limited length and, in either order:

i) nipping the substrate between the support and at least one pick-and-place roll whose period of rotation is not equal to the period of rotation of the support; and ii) applying a quantity of coating liquid to the substrate or to the pick-and-place roll; and b) rotating the support and substrate for a plurality of revolutions whereby wetted surface portions of the pick-and-place roll repeatedly contact the substrate.

2. A method according to claim 1 comprising at least two pick-and-place rolls.

3. A method according to claim 2 wherein the pick-and-place rolls do not have the same period of rotation.

4. A method according to claim 2 wherein the pick-and-place rolls have the same period of rotation.

5. A method according to claim 1 wherein the period of rotation of a pick-and-place roll can be dynamically changed to reduce or minimize coating defects.

6. A method according to claim 1 wherein a pick-and-place roll can be operated at a fixed or variable surface speed differential relative to the surface speed of the support.

7. A method according to claim 1 wherein a pick-and-place roll has a period of rotation that is not periodically related to the period of rotation of the substrate.

8. A method according to claim 7 wherein a period of rotation of the support or of a pick-arid-place roll can be varied during operation of the device to reduce or minimize coating defects.

9. A method according to claim 1 wherein the size or position of the support or of a pick-and-place roll can be varied to reduce or minimize coating defects.

10. A method according to claim 1 wherein a pick-and-place roll has a dimensionless roll size between 0.02 to 0.195, 0.225 to 0.28, 0.34 to 0.36, or 0.44 to 0.48.

11. A method according to claim 1 wherein the applied coating is discontinuous.

12. A method according to claim 1 wherein the applied coating is a pattern of stripes.

13. A method according to claim 12 wherein the pattern has a dimensionless stripe width less than about 0.2.

14. A method according to claim 12 wherein the pattern has a dimensionless stripe width between about 0.05 and about 0.15.

15. A method according to claim 1 wherein the applied coating is a pattern of drops.

16. A method according to claim 15 wherein the pattern is discontinuous.

17. A method according to claim 1 wherein the applied coating is converted to a continuous, void-free coating.

18. A method according to claim 17 wherein the converted coating has a dimensionless minimum caliper greater than about 0.9.

19. A method according to claim 1 wherein the applied coating is converted to a void-free coating having an average caliper less than 5 micrometers.

20. A method according to claim 1 wherein the applied coating is converted to a void-free coating having an average caliper less than 1 micrometer.

21. A method according to claim 1 wherein the applied coating is converted to a void-free coating having an average caliper less than 0.5 micrometers.

22. A method according to claim 1 wherein the dimensionless stripe width and dimensionless roll size provide a dimensionless minimum coating caliper of 0.9 to 1.0.

23. A method according to claim 1 wherein there are at least two pick-and-place rolls and the dimensionless stripe width and dimensionless roll size provide a dimensionless minimum coating caliper of 0.9 to 1.0.

24. A method according to claim 1 wherein there are at least two pick-and-place rolls and the dimensionless stripe width and dimensionless roll size provide a dimensionless minimum coating caliper of 0.9 to 1.0.

25. A method comprising:

a) providing a rotating support having a surface, the surface at least partially covered with a removable substrate of limited length and, in either order:

i) nipping the substrate between the support and at least one pick-and-place roll whose period of rotation is not equal to the period of rotation of the support; and ii) applying a quantity of coating liquid to the substrate or to the pick-and-place roll; and b) rotating the support and substrate for a plurality of revolutions whereby wetted surface portions of the pick-and-place roll repeatedly contact the substrate, wherein a pick-and-place roll can be operated at a variable surface speed differential relative to the surface speed of the support and the surface speed differential is varied sinusoidally as the support is revolved.

* * * * *

UNITED STATES PATENT AND TRADEMARK OFFICE

CERTIFICATE OF CORRECTION

PATENT NO. : 6,899,922 B2
DATED : May 31, 2005
INVENTOR(S) : Leonard, William K.

It is certified that error appears in the above-identified patent and that said Letters Patent is hereby corrected as shown below:

Drawings,
Sheet 10, Fig. 10, right side, insert -- Reciprocal of the Dimensionless Relative Speed Period --.

Column 4,
Line 67, delete "10/004,237" and insert -- 10/044,237 --.

Column 7,
Line 20, after "shown as" delete "a".

Column 8,
Line 34, after "constraint" insert -- . --.

Column 11,
Line 24, after "METHOD" delete ",".

Column 15,
Line 38, after "coating" insert -- caliper --.
Line 42, insert -- coating -- before "calipers".

Column 16,
Line 11, delete "pick-arid-place" and insert -- pick-and-place --.

Signed and Sealed this

Twenty-seventh Day of September, 2005

JON W. DUDAS
*Director of the United States Patent and Trademark Office*